US012617012B2

(12) United States Patent
Nobrega et al.

(10) Patent No.: US 12,617,012 B2
(45) Date of Patent: May 5, 2026

(54) REDRAW AND IRONING SYSTEM

(71) Applicant: Novelis Inc., Atlanta, GA (US)

(72) Inventors: Carlos G. W. Nobrega, Kennesaw, GA (US); Jaesuk Park, Marietta, GA (US); Matheus Guedes, Acworth, GA (US); Jay Michael Shores, Alpharetta, GA (US); Robert Lehman, Marietta, GA (US)

(73) Assignee: Novelis Inc., Atlanta, GA (US)

( * ) Notice: Subject to any disclaimer, the term of this patent is extended or adjusted under 35 U.S.C. 154(b) by 197 days.

(21) Appl. No.: 17/309,367

(22) PCT Filed: Dec. 2, 2019

(86) PCT No.: PCT/US2019/063936
§ 371 (c)(1),
(2) Date: May 21, 2021

(87) PCT Pub. No.: WO2020/117641
PCT Pub. Date: Jun. 11, 2020

(65) Prior Publication Data

US 2022/0008981 A1 Jan. 13, 2022

Related U.S. Application Data

(60) Provisional application No. 62/774,951, filed on Dec. 4, 2018.

(51) Int. Cl.
*B21D 22/28* (2006.01)
*B21D 22/30* (2006.01)
*B21D 51/26* (2006.01)

(52) U.S. Cl.
CPC ..... *B21D 51/26* (2013.01); *B21D 22/28* (2013.01); *B21D 22/30* (2013.01)

(58) Field of Classification Search
CPC ..... B21D 22/28; B21D 22/30
See application file for complete search history.

(56) References Cited

U.S. PATENT DOCUMENTS 2,531,663 A * 11/1950 Giovanni ..... B21D 22/28 72/352
3,423,985 A * 1/1969 Stolle ..... B21D 45/06 72/348

(Continued)

FOREIGN PATENT DOCUMENTS

CN 102773327 A 11/2012
CN 206690583 U 12/2017

(Continued)

OTHER PUBLICATIONS

European Application No. 19827989.5 , Office Action, Mailed on Apr. 7, 2022, 4 pages.

(Continued)

*Primary Examiner* — Christopher L Templeton
*Assistant Examiner* — Matthew Stephens
(74) *Attorney, Agent, or Firm* — Kilpatrick Townsend & Stockton LLP

(57) ABSTRACT

A can redraw and ironing system includes a ram, a punch, and a sensor system. The ram includes a ram body and a ram nose. The punch is supported on the ram nose and is configured to engage a metal blank during an ironing process. The sensor system includes a first sensor that detects a total force on the ram and a second sensor that detects a force on the ram nose.

12 Claims, 5 Drawing Sheets

(56) References Cited

U.S. PATENT DOCUMENTS

| | | | | |
|---|---|---|---|---|
| 3,951,296 | A * | 4/1976 | Swanson | B21D 22/30 220/672 |
| 4,589,270 | A | 5/1986 | Lee, Jr. et al. | |
| 4,779,442 | A * | 10/1988 | Welsh | B21D 22/28 72/347 |
| 5,257,523 | A | 11/1993 | Hahn et al. | |
| 8,234,897 | B2 * | 8/2012 | Kuwayama | B21C 51/00 72/21.4 |
| 2008/0229801 | A1 * | 9/2008 | Woulds | B21D 37/16 72/347 |
| 2018/0133770 | A1 * | 5/2018 | Swedberg | G01L 1/22 72/352 |
| 2018/0207706 | A1 * | 7/2018 | Swedberg | B21D 22/283 72/352 |
| 2018/0281045 | A1 * | 10/2018 | Sines | B21D 22/286 72/352 |

FOREIGN PATENT DOCUMENTS

| | | | |
|---|---|---|---|
| EP | 0017434 | A1 | 10/1980 |
| JP | 06184429 | A | 7/1994 |
| WO | 2018020207 | A1 | 2/2018 |
| WO | 2018197827 | A1 | 11/2018 |

OTHER PUBLICATIONS

Japanese Application No. 2021-531808 , Office Action, Mailed on Apr. 26, 2022, 6 pages.
Korean Application No. 10-2021-7014122 , Office Action, Mailed on Feb. 12, 2022, 11 pages.
Canadian Application No. 3,117,990, Office Action, Mailed on Aug. 8, 2022, 3 pages.
Japanese Application No. 2021-531808, Notice of Decision to Grant, Mailed on Aug. 16, 2022, 3 pages.
Korean Application No. 10-2021-7014122, Notice of Decision to Grant, Mailed on Aug. 24, 2022, 5 pages.
Chinese Application No. 201980080268.1, "Office Action", Mailed on Nov. 4, 2022, 32 pages.
International Patent Application No. PCT/US2019/063936 , International Search Report and Written Opinion dated Mar. 18, 2020, 10 pages.
Sun, "Advancements in Manufacturing D&I can Bodies", Aluminum Alloys for Packaging III, Proceedings of the symposium presented at the 1998 TMS Annual Meeting in San Antonio, Texas on Feb. 16-19, 1998, Edited by Subodh K. Das, pp. 135-149, 1998, pp. 135-149, The Minerals, Metals & Materials Society, Warrendale, Pennsylvania, US.
European Application No. 19827989.5, "Intention to Grant", Mailed on Sep. 20, 2022, 7 pages.
Brazilian Application No. BR112021008081-3, "Office Action", mailed Apr. 11, 2023, 5 pages.
Canadian Application No. 3,117,990, "Notice of Allowance", mailed Mar. 28, 2023, 1 page.
Chinese Application No. 201980080268.1, "Office Action", mailed Apr. 20, 2023, 25 pages.
CN Application No. 201980080268.1, "Notice of Decision to Grant", mailed Nov. 13, 2023, 6 pages.
CN Application No. 201980080268.1, "Office Action", Aug. 11, 2023, 7 pages.
MX Application No. MX/A/2021/006247 , "Office Action", Jul. 29, 2024, 4 pages.
MX Application No. MX/A/2021/006247 , "Notice of Allowance", Nov. 7, 2024, 3 pages.
Brazilian Patent Application No. BR112021008081-3, "Office Action", Feb. 18, 2025, 3 pages.
Brazilian Patent Application No. BR112021008081-3, "Notice of Allowance", Aug. 26, 2025, 4 pages.

* cited by examiner

REDRAW AND IRONING SYSTEM

CROSS-REFERENCE TO RELATED APPLICATIONS

This application is a U.S. national phase under 35 U.S.C. § 371 of International Patent Application No. PCT/US2019/063936, filed Dec. 2, 2019 and entitled REDRAW AND IRONING SYSTEM, which claims the benefit of U.S. Provisional Application No. 62/774,951, filed on Dec. 4, 2018 and entitled REDRAW AND IRONING SYSTEMS AND METHODS, the content of which are hereby incorporated by reference in their entirety.

FIELD OF THE INVENTION

This application generally relates to metalworking techniques, and, more particularly, to improved systems and methods for redraw and ironing.

BACKGROUND

Many cans or cylindrical articles such as food and drink cans, fire extinguishers, gas cans, oil filter casings, damper casings, and many other types of articles, are made from metal materials such as aluminum, aluminum alloys, stainless steels, brass, low-carbon steel, and various other suitable materials. The process of forming the can or cylindrical article from the metal material generally includes making a blank out of the metal material and then drawing the blank to form a shallow cup. After the shallow cup is initially drawn, it may be redrawn to reduce its diameter and deepen the cup. The cup is then ironed to reduce the wall thickness to ultimately provide the body for the can or cylindrical article. Ironing generally includes axially driving the metal material through one or more ironing dies to reduce the wall thickness with an ironing system having a ram and a punch. Various process conditions may be present and various forces can be applied to the punch, ironing die, and/or metal material during redraw and ironing, and these forces may correlate to various factors that can be controlled during redraw and ironing. However, existing redraw and ironing systems are unable to measure these forces or process conditions, and as such are unable to effectively control the various aspects of the process of redraw and ironing.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to certain examples of the present disclosure, an ironing system includes a ram, a punch, and a sensor system. The ram includes a ram body and a ram nose. The punch is supported on the ram nose and is configured to engage a metal blank during an ironing process. The sensor system includes a first sensor and a second sensor. The first sensor is configured to detect a total force on the ram, and the second sensor is configured to detect a force on a sidewall or on a bottom of a can formed from the metal blank.

According to various examples of the present disclosure, an ironing system includes a ram and a sensor system. The ram includes a ram body and a ram nose. The sensor system includes a first sensor on the ram body and a second sensor on the ram nose. The first sensor is configured to detect a total force on the ram, and the second sensor is configured to detect a force on a sidewall or on a bottom of a can formed from the metal blank.

According to some examples of the present disclosure, a method of controlling redraw and ironing forces on a can during an ironing process includes engaging a punch of an ironing system with a metal blank, where the punch is supported on a ram nose of a ram of the ironing system. The method also includes directing the metal blank through an ironing die by driving the ram to form a can body. The method further includes measuring a force on the ram nose with a first sensor of a sensor system as nose force data and measuring a total force on the ram with a second sensor as total force data while directing the metal blank through the ironing die.

According to certain embodiments of the present disclosure, a redraw and ironing system includes a ram, a punch, and a sensory system. The ram includes a ram body and a ram nose. The punch is supported on the ram nose and is configured to engage a metal blank during a redraw and ironing process. The sensor system includes a first sensor and a second sensor, where the first sensor and the second sensor are configured to detect a process condition during the redraw and ironing process.

Various implementations described in the present disclosure can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references such as "up," "down," "top," "bottom," "left," "right," "front," and "back," among others, are intended to refer to the orientation as illustrated and described in the figure (or figures) to which the components and directions are referencing.

Figure 1:
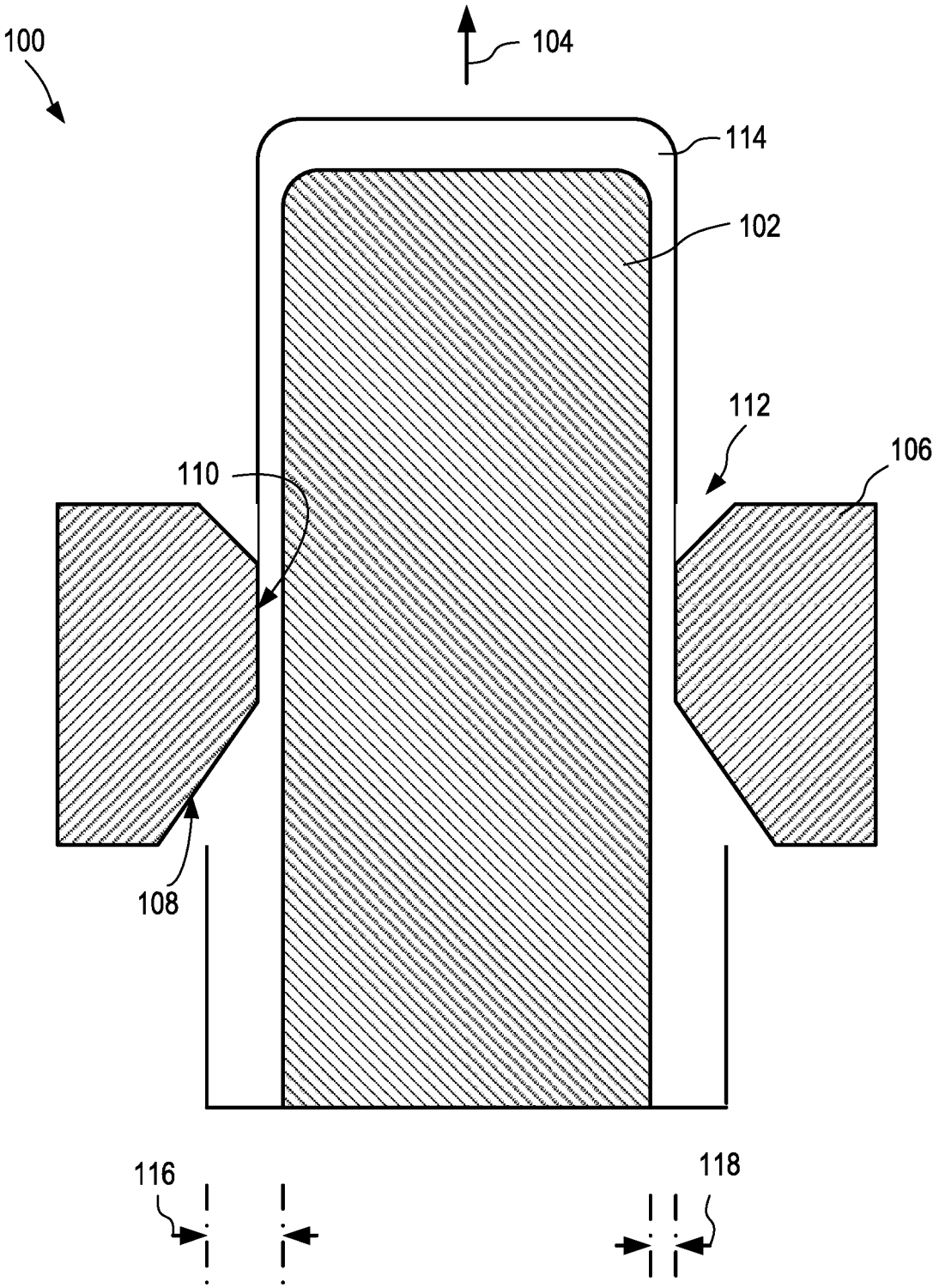
FIG. 1 is a view of a portion of an ironing system according to aspects of the current disclosure.
Figure 2:
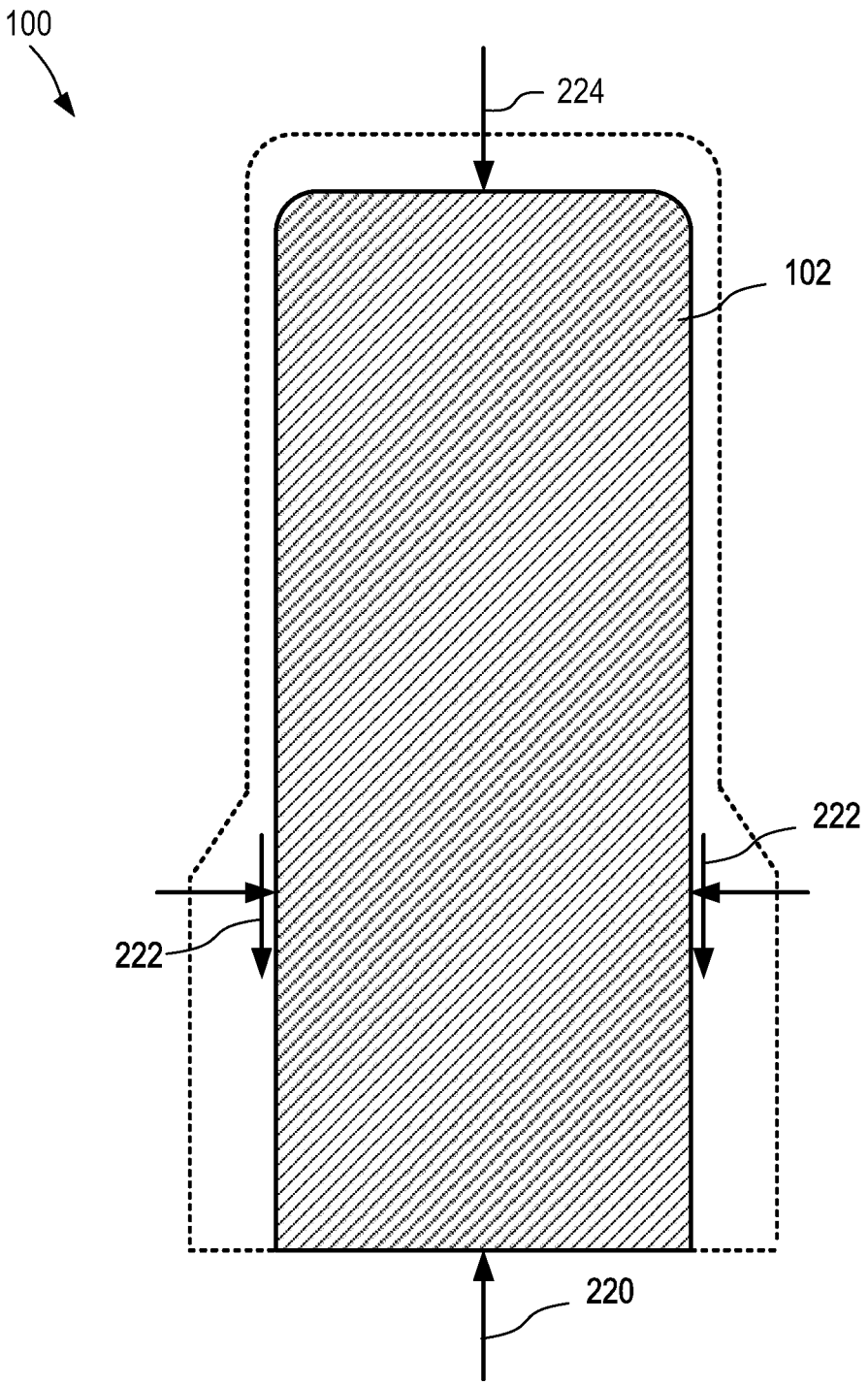
FIG. 2 illustrates forces on a punch of the ironing system of FIG. 1 during ironing.

FIGS. 1 and 2 illustrate a portion of an ironing system 100 according to certain aspects of the present disclosure. The ironing system 100 includes a punch 102, a ram assembly (not shown in FIG. 1) that drives the punch 102 in an axial direction 104, and at least one ironing die 106. As illustrated in FIG. 1, the ironing die 106 includes an entry surface 108 and an inner surface 110. The inner surface 110 defines an opening or gap 112. During ironing, the punch 102 drives a metal article 114 through the gap 112 of the ironing die 106 in the axial direction 104 such that the sidewalls of the metal article 114 are ironed from an initial thickness 116 to an end thickness 118. The ironing process may be repeated as many times as desired (and with as many types of ironing dies as desired) to produce a body having a desired wall thickness.

FIG. 2 illustrates an example of some of the forces on the punch 102 during ironing. A total forming force 220, is the force that is applied by the punch 102 (through the ram assembly) onto the metal article during ironing. The total forming force 220 generally represents the sum of a friction force 222 between the punch 102 and the sidewalls of the metal article and a punch nose force 224 between the punch 102 and the bottom of the metal article. In some cases, the total forming force 220 is measured on the ram assembly itself, on a die, on a die holder, and/or on a bolster plate. While the total forming force 220 is the sum of the friction force 222 and the punch nose force 224, existing redraw and ironing systems are unable to independently measure or determine the friction force 222 and/or the punch nose force 224.

Figure 3:
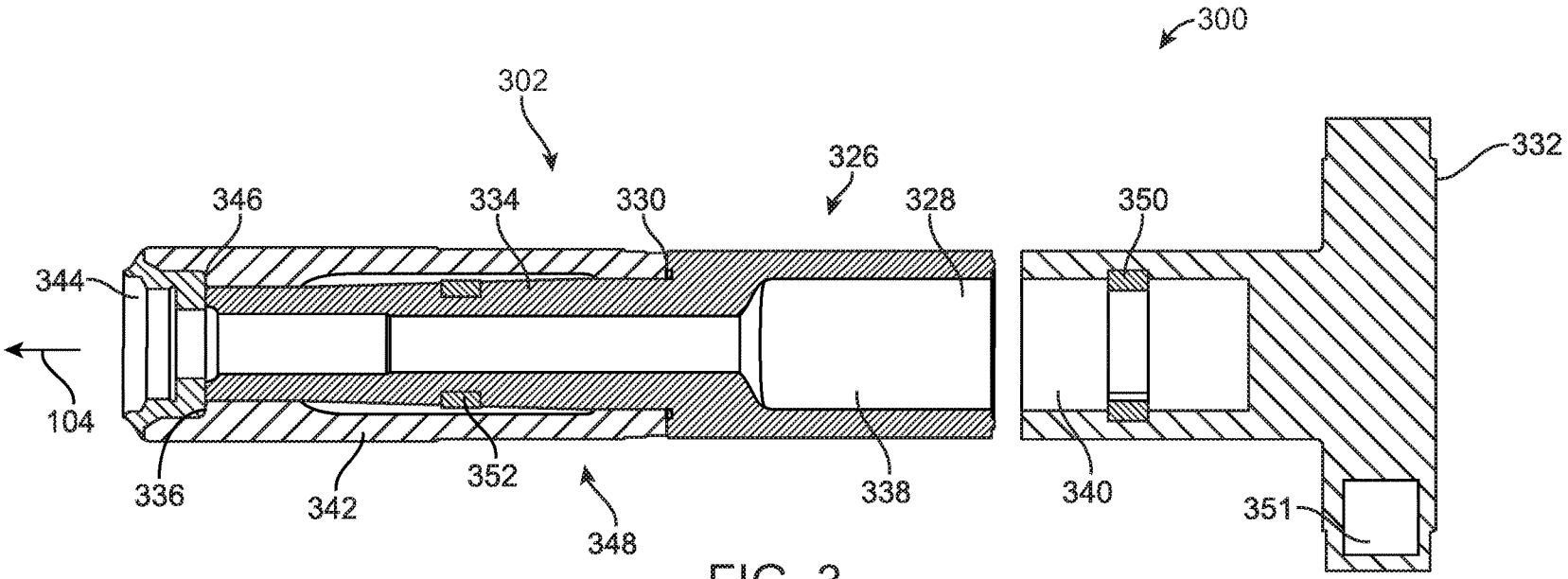
FIG. 3 is a view of a portion of an ironing system according to aspects of the current disclosure.
Figure 4:
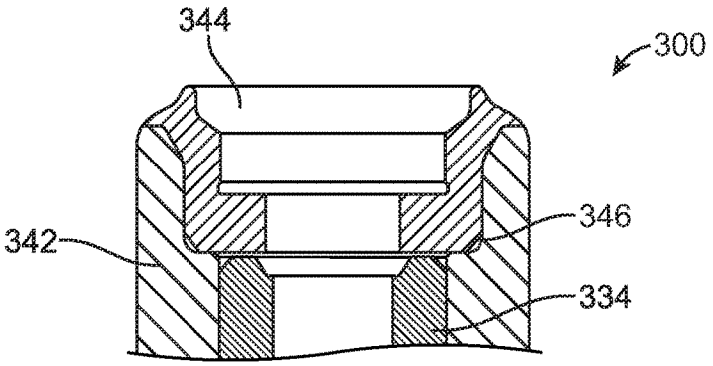
FIG. 4 is a view of another portion of the ironing system of FIG. 3.

FIGS. 3 and 4 illustrate portions of a redraw and ironing system 300 that includes a punch 302, a ram assembly 326, and a sensor system 348 according to aspects of the present disclosure.

The ram assembly 326 includes a ram body 328 having a front end 330 and a back end 332. A ram nose 334 extends from the front end 330 of the ram body 328 and terminates at a ram nose end 336. In various aspects, a diameter of the ram nose 334 is less than the diameter of the ram body 328. The ram assembly 326 is driven in the axial direction 104 by an actuator during the ironing process to form the metal article into a cup. In some examples, the actuator is a linear actuator, although it need not be in other examples. In various aspects, the ram assembly 326 is driven at various suitable speeds to produce a desired number of cups per minute. As some non-limiting examples, the ram assembly 326 may be driven at speeds of appropriately 400-450 strokes per minute, where one stroke refers to one cycle of engaging, forming, and releasing one cup. In other words, at 200-450 strokes per minute, the assembly must engage, form, and release cups at a rate of about 200-450 strokes per minute.

As illustrated in FIG. 3, in various examples, the sensor system 348 includes a first sensor 350 and a second sensor 352 that are configured to detect one or more process conditions. In some cases, additional sensors can be used to measure other aspects of the redraw and ironing system. Process conditions may include, but are not limited to, forces or loads, pressures, temperatures, sounds, vibrations, accelerations, combinations thereof, or other suitable process conditions of the ironing process. As such, the sensors 350, 352 may be various input devices suitable for receiving input (e.g., a desired temperature distribution profile, a desired shape, etc.) from an operator or some other source. For example, the sensors 350, 352 may include, but are not limited to, a load cell, an accelerometer, an optical sensor, a magnetic sensor, an energy sensor, a current sensor, a frequency detector, a thermal sensor, a pressure sensor, any suitable sensor, a device with a user interface, or any combinations thereof. While two sensors are illustrated, in other examples, the sensor system 348 may have more than two sensors, such as when more than one type of process condition is detected. The sensors 350 and 352 may be load cells or various other suitable sensors. The sensors 350 and 352 may be communicatively connected to a controller 351 or other suitable device.

As one non-limiting example, the first sensor 350 may be configured to detect the amount of the total forming force 220, and the second sensor 352 may be configured to detect the amount of the punch nose force 224. In this example, the sensors 350 and 352 may be communicatively coupled to the controller 351, which may use the force data to determine the friction force 222 and/or other forces that occur during ironing.

As other non-limiting examples, the first sensor 350 and/or the second sensor 352 may be pressure sensor(s) configured to detect blow off pressure and the timing of blow off pressure, temperature sensor(s) configured to detect temperatures at various locations on the ironing system 300 during various stages of ironing, vibration sensor(s) configured to detect vibrations of various components of the ironing system 300 during various stages of ironing, acceleration sensor(s) configured to detect movement and/or positioning of components of the ironing system 300 during various stages of ironing, etc.

The controller 351 can include one or more of a general purpose processing unit, a processor specially designed for ironing analysis and/or ironing applications, a processor specially designed for wireless communications (such as a Programmable System On Chip from Cypress Semiconductor or other suitable processors). A memory may be provided with the controller 351 to store data gathered by various sensors of the sensor system 348, although it need not include a memory in other examples. The memory may include a long-term storage memory and/or a short-term working memory. The memory may be used by the controller 351 to store a working set of processor instructions. The processor may write data to the memory. The memory may include a traditional disk device. In some aspects, the memory could include either a disk based storage device or one of several other type storage mediums to include a memory disk, USB drive, flash drive, remotely connected storage medium, virtual disk drive, or the like. Various other features including, but not limited to, a communication circuit/unit, an optional display, an optional speaker, and/or power storage unit may also be included in the controller 351. In some aspects, some or all of the components of the controller 351 may be included together in a single package or sensor suite, such as within the same enclosure. In additional or alternative aspects, some of the components may be included together in an enclosure and the other components may be separate. Thus, the controller 351 may be a distributed system. This is merely one example and other configurations may be implemented. may be provided on the ram body 328, although in other examples, the controller 351 may be provided at other locations on the ram assembly 326 and/or at other suitable locations that may or may not be on the ram assembly 326. As such, the particular location of the controller 351 should not be considered limiting on the current disclosure.

In various aspects, the controller 351 communicates data with the sensors 350, 352 (and possibly other sensors) such that the controller 351 receives a data signal from the sensors 350, 352. In various examples, the data signals include forces, pressures, temperatures, accelerations, vibrations, etc. detected by the various sensors. The controller 351 can analyze the data from the sensors 350, 352 and control one or more parameters of the ironing system 300 (e.g., parameters that affect the ironing process). In other examples, the controller 351 can control the one or more parameters based on input received prior to the ironing process.

The first sensor 350 and the second sensor 352 may be provided at various locations within the system 300 as desired. As some non-limiting examples, the first sensor 350 and/or the second sensor 352 may be provided on the ram body, the ram nose, a separate part or component of the system 300 behind the ram, within an inner chamber 340 of the ram body 328, embedded on the punch nose, another part of the press behind the ram, a separate part or component in front of the ram nose, the punch sleeve 342, on a spacer between the ram body and the punch nose 344, on a spacer behind the punch sleeve 342 (e.g., between the punch sleeve 342 and the ram body 328, and/or various other locations. As such, the locations illustrated for the first sensor 350 and/or the second sensor 352 should not be considered limiting on the current disclosure. FIGS. 3-6 illustrate an example where the first sensor 350 is provided on the ram body 328, and the second sensor 352 is provided on the ram nose 334. However, as mentioned previously, the location of the sensors 350 and/or 352 should not be considered limiting on the current disclosure. For example, in other cases, the first sensor 350 may be a separate part behind the ram, another part of the press behind the ram, and/or provided at various other locations. Similarly, the second sensor 350 may be a separate part in front of the ram, and/or may be provided at various other locations. In some examples, the second sensor 352 is provided on the ram nose 334 between the front end 330 of the ram body 328 and the ram nose end 336. In other examples, the second sensor 352 is provided at the ram nose end 336. In various examples, the first sensor 350 and/or the second sensor 352 are integrally provided with various components of the ram assembly 326 such that they do not interfere with regular operation of the ram assembly 326 at high speeds or other operating conditions. As one non-limiting example, the first sensor 350 and second sensor 352 may be provided integrally with the ram body 328 such that the ram assembly 326 can run continuously at high speeds without interference from the sensors.

As illustrated in FIG. 3, in some optional examples, the ram assembly 326 includes an inner surface 338 that defines the inner chamber 340. The inner chamber 340 optionally extends to the ram nose end 336, although it need not in other examples. In some optional examples, the first sensor 350 is provided in the inner chamber 340, although it need not be in other examples. In certain examples, the ram assembly 326 includes a pressure system that maintains a constant pressure within the inner chamber 340 such that coolant and/or moisture inside the ram body 328 is minimized and/or reduced. As one non-limiting example, the pressure system may maintain a pressure of approximately 1-20 PSI within the inner chamber, such as approximately 5-10 PSI within the inner chamber 340, although in other examples, other pressures may be maintained. By minimizing and/or reducing coolant or moisture within the inner chamber 340, the potential for the sensors 350, 352 to short circuit is minimized and/or reduced.

The punch 302 includes a punch sleeve 342 and a punch nose 344. The punch sleeve 342 is supported on the ram nose 334. In various aspects, the punch sleeve 342 abuts the ram body 328 at the front end 330. In some examples, the punch sleeve 342 and the punch nose 344 are separate components such that the punch nose 344 is movable relative to the punch sleeve 342. In other examples, the punch sleeve 342 and the punch nose 344 are formed as a single or monolithic component. In the example of FIGS. 3 and 4, the punch sleeve 342 defines a recess 346 that receives at least a portion of the punch nose 344. In some examples, the recess 346 is dimensioned such that the punch nose 344 can move freely relative to the punch sleeve 342, which may allow for the ram nose 334 to capture the punch nose force 224.

During ironing, the punch nose 344 engages the bottom of the metal article and receives the punch nose force 224. That force is transferred to the punch sleeve 342, which also frictionally engages the sidewalls of the metal article and receives the friction force 222. The combined friction force 222 and the punch nose force 224 (which together form the total forming force 220) are transferred from the punch sleeve 342 to the ram body 328. The punch nose force 224 is also transferred to the ram nose 334. In some examples, the punch sleeve 342 is supported on the ram nose 334 such that the ram nose 334 does not receive the effect from the friction force 222. In various examples, and when the sensors 350, 352 are force sensors, because the first sensor 350 is provided on the ram body 328 and the second sensor 352 is provided on the ram nose 334, the first sensor 350 can detect the amount of the total friction force 220 as total force data. Likewise, the second sensor 352 can detect the punch nose force 224 as bottom force data. In some optional examples, the first sensor 350 transmits the total force data to the controller 351 and the second sensor 352 transmits the bottom force data to the controller 351. In certain examples, the first sensor 350 and/or the second sensor 352 may transmit the data in real time; however, in other examples, the first sensor 350 and/or the second sensor 352 may transmit the data at predetermined time intervals. In various examples, the controller 351 can determine the friction force 222 based on the total force data and the bottom force data. For example, in some cases, the controller 351 can determine the difference between the total force data and the bottom force data to determine the friction force 222. As mentioned, in other examples, the sensors 350, 352 may detect other process conditions, and the controller 351 can determine the other process conditions to control various aspects of the ironing system and/or ironing process.

In some cases, the controller 351 may determine a process condition curve for one or more process conditions based on the data from the sensors 350, 352. In various examples, the process condition curve may be determined from dry strokes (i.e., strokes without a metal article) and/or from strokes with a metal article ("loaded strokes"). In certain examples, the process condition data may be synchronized with position data of the ironing system 300 to obtain a process condition curve by stroke. The controller 351 may further control the process condition curves to determined various features of a particular process condition, such as an average process condition (e.g., average load or average temperature), variation in a process condition during a stroke, frequency of a process condition, etc. As one non-limiting example, an average process condition may be determined from one or more process conditions for dry strokes and loaded strokes. As another non-limiting example, the dry stroke process condition curve may be subtracted from the loaded stroke process condition curve to remove the effect of inertia and/or other factors intrinsic to the ironing process that are not related to forming of the metal article. As another non-limiting example, the dry stroke process condition curve may be used to establish a zero condition value and tare the process condition curve. As another non-limiting example, process conditions for a particular portion of the process (e.g., redraw or at various dies) or at a particular position on the tool (e.g., midwall, thickwall, wear bands, etc.) may be determined based on the process condition curve. In some non-limiting examples, the measured process condition curve (and/or an average of one or more process condition curves) may be compared with a control curve to determine if any adjustments to the ironing process and/or ironing system are needed. In some non-limiting examples, portions of the process condition curve may be grouped in clusters and used to predict potential failure, bad conditions, or to troubleshoot.

Through the redraw and ironing system 300, the total forming force 220 and the punch nose force 224 can be directly measured, and the friction force 222 can be indirectly determined based on the detected total forming force 220 and the punch nose force 224. In certain aspects, based on any one or combination of the detected total forming force 220, friction force 222, and/or punch nose force 224, various aspects of the redraw and ironing system 300 can be controlled to control the ironing process. For example, in some cases, a type of metal used for the metal article, various surface characteristics of the punch 304 and/or the metal article, a type of lubrication used, a design of the ram, punch, or ironing die, a machine speed, or various other aspects of the redraw and ironing system 300 may be controlled based on the detected forces. As one example, higher friction forces 222 on the sidewall of the metal article during ironing may directly correlate with an increased likelihood of defects, or "tear offs." In some cases, based on the detected friction forces 222, various aspects of the redraw and ironing system 300 may be controlled to reduce the incidence of tear offs, control redraw forces, monitor and control wear on dies, control formation of wrinkles, monitor and control lubrication deficiencies, monitor and control punch through or other types of defects, etc. In some cases, the forces detected by the sensors 350 and 352 may be used to regulate process parameters to reduce operating costs and/or to improve production efficiency. As a non-limiting example, a lower detected force may indicate an opportunity to decrease an amount of lubrication and/or increase speed to reduce operating costs, and a higher force may indicate that dies are worn out to reduce or avoid down time.

Figure 5:
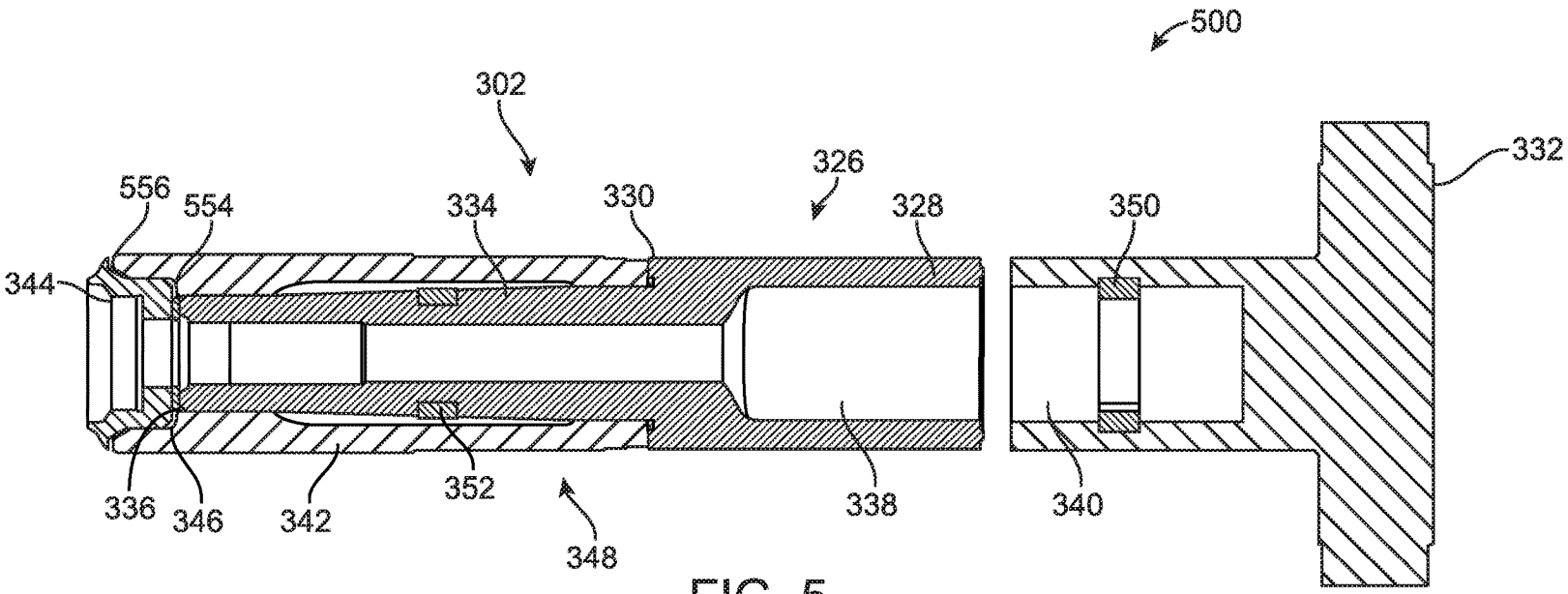
FIG. 5 is a view of a portion of an ironing system according to aspects of the current disclosure.
Figure 6:
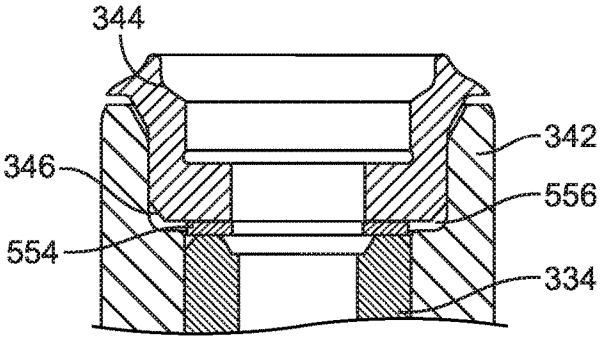
FIG. 6 is a view of another portion of the ironing system of FIG. 5.

FIGS. 5 and 6 illustrate an example of another redraw and ironing system 500. The redraw and ironing system 500 is substantially similar to the redraw and ironing system 300 except that the redraw and ironing system 500 further includes a spacer 554 positioned between and abutting to the ram nose 334 and the punch nose 344. As best illustrated in FIG. 6, the spacer 554 positioned between the ram nose 334 and the punch nose 344 defines a gap 556 between the punch nose 344 and the punch sleeve 342. In various aspects, by defining the gap 556, the spacer 554 directs the punch nose force 224 on the punch nose 344 onto the ram nose 334 where it can be detected by the second sensor 352. In some examples, the spacer 554 directs the punch nose force 224 onto the ram nose 334 before the punch nose 344 engages the punch sleeve 342. In other examples, the spacer 554 maintains the gap 556 such that the punch nose force 224 is not transferred to the punch sleeve 342. In some optional examples, the spacer 554 may be a sensor of the sensor system 348. In such examples, the second sensor 352 may be omitted, or the spacer 554 may be used in addition to the second sensor 352. Like the sensors 350 and 352, the location of the spacer 554 should not be considered limiting on the current disclosure, and could be provided in various other locations as desired. As one non-limiting example, the spacer 554 may be embedded on the punch. In other examples, the spacer 554 may be provided in various other locations as desired.

Figure 7:
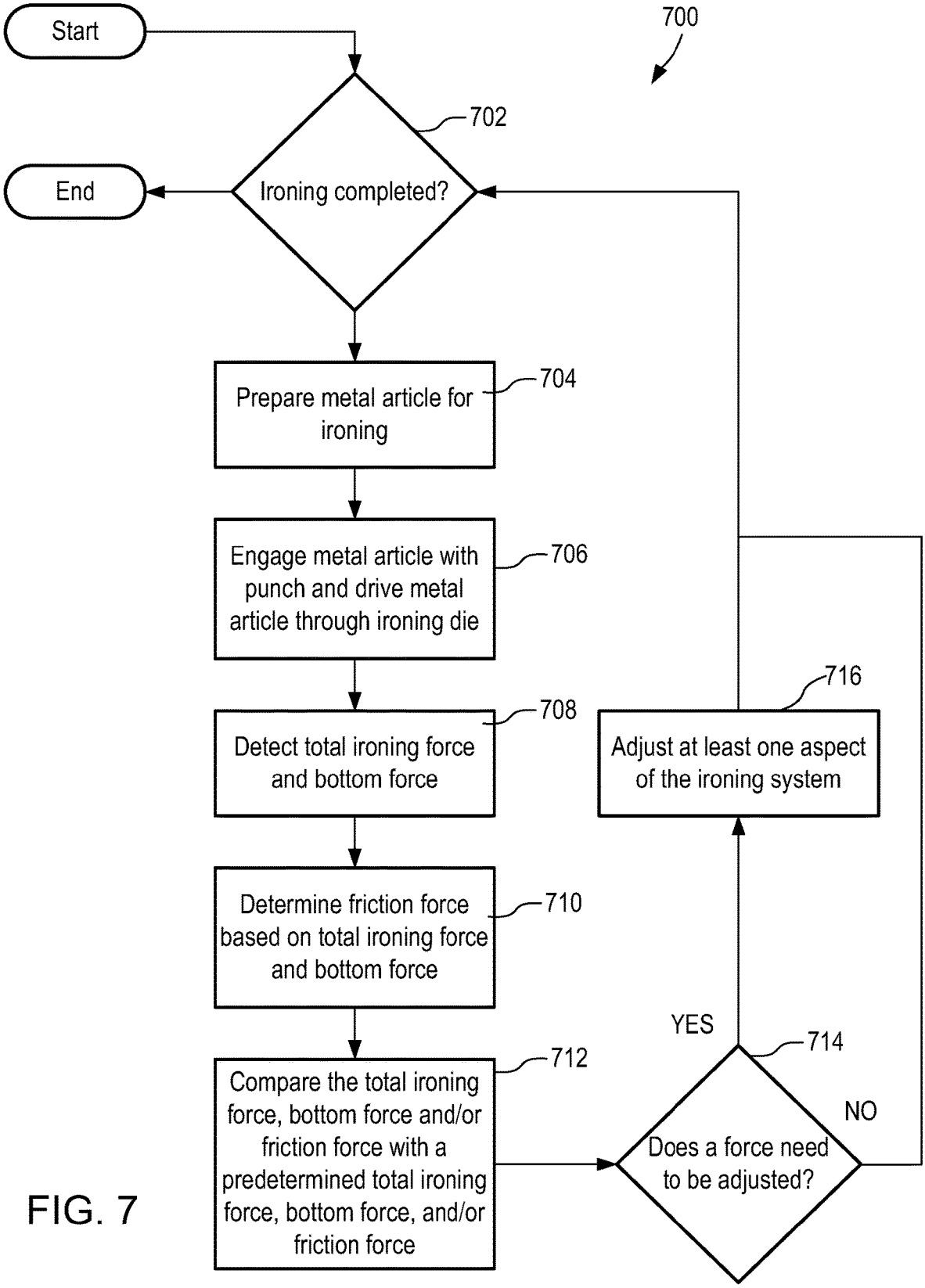
FIG. 7 illustrates a process of measuring and controlling redraw and ironing forces during ironing according to aspects of the current disclosure.

FIG. 7 is a process 700 of measuring and controlling redraw and ironing forces during a redraw and ironing process according to certain aspects of the current disclosure.

At block 702, it is determined whether the redraw and ironing process is completed. If the redraw and ironing process is completed, the process ends.

At block 704, the metal article 114 is prepared for redraw and ironing. Preparing the metal article can include cutting it to the appropriate shape and dimensions, applying lubrication, etc. By way of example, but not limitation, a disk is blanked out of an aluminum sheet. The blank may be formed by any method known in the art, such as by punching or cutting. In one embodiment an outer cutting tool cuts an aluminum sheet into a disk, and the disk is immediately drawn into a cup. The disk may be drawn into a cup with an inner cup forming tool. The cutting and drawing may be carried out by a double action press, where the first action performs disk cutting and the second action performs cup forming in a continuous motion. In various aspects, the formed cup has a fairly large diameter that requires further operation to reduce its size to a smaller diameter to facilitate subsequent operations. This is accomplished by a redraw process. A suitable redraw process may include, for example, the direct redraw process wherein the cup is drawn from inside of the cup base by using similar cup forming tools to reduce its diameter and displace the material to form a taller cup wall. Another suitable redraw process for use in the methods described herein is the reverse redraw process wherein the cup is drawn from the bottom of the cup and metal is folded in an opposite direction to form the taller cup wall. The methods disclosed herein may include either of these redraw processes, but are not limited to these redraw processes. Depending on machine requirements, limitations, and process requirements, there may be multiple redraw processes or combinations of redraw processes. After the cup is drawn to a final diameter, as described in detail below, an ironing tool will stretch and thin the cup wall to achieve the final wall thickness and length. Preparing the metal article can also include positioning the metal article 114 relative to the punch 304 and/or the ironing die 106 for ironing.

At block 706, the punch 304 engages the metal article 114 and drives the metal article 114 in the axial direction 104 through the ironing die 106. As the metal article 114 is driven through the ironing die 106, a wall thickness of the metal article 114 is reduced, and a cup is formed.

At block 708, the total forming force 220 is detected with the first sensor 350 of the sensor system 348 and the punch nose force 224 is detected with the second sensor 352 of the sensor system 348. Optionally, block 708 includes measuring the punch nose force 224 with the spacer 554 in addition to or in place of the second sensor 352. In some aspects, block 708 and block 706 are performed simultaneously, although they need not be in other examples. It will be appreciated that in other examples, the first sensor 350 and/or the second sensor 352 may detect additional and/or alternative process conditions other than force, such as pressure, temperature, acceleration, frequency, vibration, etc. as desired.

At block 710, the friction force 222 between the can body and the punch 304 is determined based on the nose force data and the total force data. In various examples, the friction force 222 is determined by the controller 351 of the redraw and ironing system. In other examples, such as when process conditions other than forces are measured, block 710 may be omitted.

At a block 712, the detected total ironing force, bottom force, and/or friction force are compared to a predetermined total ironing force, bottom force, and/or friction force. In some examples, the predetermined total ironing force, bottom force, and/or friction force may correlate with a characteristic of the cup. As one example, the predetermined total ironing force, bottom force, and/or friction force may correspond with a particular incidence of defects or tear offs. In other examples, such as when process conditions other than forces are measured, block 712 may include comparing the detected process condition (e.g., pressure, temperature, acceleration, frequency, vibration, etc.) with a predetermined process condition. In such examples, the predetermined process condition may correlate with a characteristic of the cup.

At block 714, it is determined whether any one or combination of the total ironing force, bottom force, and/or friction force needs to be adjusted. In certain cases, the determination in block 714 is made based on the detected total ironing force, bottom force, and/or friction force being equal to or different from the predetermined total ironing force, bottom force, and/or friction force. As one example, the determination in block 714 may be made based on the comparison of the detected friction force with a predetermined friction force that corresponds with a high incidence of tear offs. In other examples, such as when process conditions other than forces are measured, block 714 may include determining whether the process condition (e.g., pressure, temperature, acceleration, frequency, vibration, etc.) needs to be adjusted. The determination in these cases may be based on the detected process condition being equal to or different from the predetermined process condition.

At block 716, at least one aspect of the redraw and ironing system is controlled based on the determination that one of the forces needs to be adjusted (or that one or more process conditions needs to be adjusted). As one example, a lubrication on the punch, a surface characteristic of the punch, a property of the metal forming the metal article, and/or a machine speed of the ram are adjusted based on a detected friction force being equal to or greater than a predetermined friction force that corresponds with a high incidence of tear offs.

Optionally, once the drawing and ironing process is completed, a doming operation is performed wherein the bottom, i.e., the dome profile, is formed.

A collection of exemplary examples, including at least some explicitly enumerated as "ECs" (Example Combinations), providing additional description of a variety of example types in accordance with the concepts described herein are provided below. These examples are not meant to be mutually exclusive, exhaustive, or restrictive; and the invention is not limited to these example examples but rather encompasses all possible modifications and variations within the scope of the issued claims and their equivalents.

EC 1. A redraw and ironing system comprising: a ram comprising a ram body and a ram nose; a punch supported on the ram nose and configured to engage a metal blank during an ironing process; and a sensor system comprising a first sensor and a second sensor, wherein the first sensor is configured to detect a total force on the ram, and wherein the second sensor is configured to detect a force on a sidewall or on a bottom of a can formed from the metal blank.

EC 2. The redraw and ironing system of any of the preceding or subsequent example combinations, wherein the first sensor is on the ram body and the second sensor is on the ram nose.

EC 3. The redraw and ironing system of any of the preceding or subsequent example combinations, wherein the ram nose extends from a front end of the ram body and comprises a ram nose end, wherein the first sensor is on the ram body, and wherein the second sensor is on the ram nose between the front end of the ram body and the ram nose end.

EC 4. The redraw and ironing system of any of the preceding or subsequent example combinations, wherein the ram nose extends from a front end of the ram body and comprises a ram nose end, wherein the first sensor is on the ram body, and wherein the second sensor is on the ram nose end.

EC 5. The redraw and ironing system of any of the preceding or subsequent example combinations, wherein the punch comprises a punch nose and a punch sleeve, wherein the punch nose is configured to engage a metal blank during processing, and wherein the punch sleeve is supported on the ram nose between the punch nose and the ram body.

EC 6. The redraw and ironing system of any of the preceding or subsequent example combinations, wherein the ram body comprises a front end and a back end, wherein the ram nose extends from the front end, and wherein the punch sleeve abuts the ram body at the front end.

EC 7. The redraw and ironing system of any of the preceding or subsequent example combinations, further comprising a spacer between the punch nose and the ram nose, wherein the spacer defines a gap between the punch nose and the punch sleeve such that a force on the punch nose is directed to the ram nose before the punch nose engages the punch sleeve.

EC 8. The redraw and ironing system of any of the preceding or subsequent example combinations, wherein the spacer comprises a third sensor of the sensor system configured to detect the force directed from the punch nose to the ram nose.

EC 9. The redraw and ironing system of any of the preceding or subsequent example combinations, wherein the punch sleeve is movable relative to the punch nose.

EC 10. The redraw and ironing system of any of the preceding or subsequent example combinations, further comprising a controller communicatively coupled to the first sensor and the second sensor, wherein the controller is configured to: receive total force data from the first sensor; receive ram nose force data from the second sensor; and determine a friction force between the punch and a can body based on the total force data and the ram nose force data.

EC 11. The redraw and ironing system of any of the preceding or subsequent example combinations, wherein the first sensor and the second sensor each comprise a load cell.

EC 12. The redraw and ironing system of any of the preceding or subsequent example combinations, wherein the ram comprises an outer surface and an inner surface defining an inner chamber, wherein the second sensor is on the outer surface of the ram on the ram nose, and wherein the first sensor is within the inner chamber in the ram body.

EC 13. The redraw and ironing system of any of the preceding or subsequent example combinations, further comprises a pressure system configured to apply a constant pressure within the inner chamber.

EC 14. A redraw and ironing system comprising: a ram comprising a ram body and a ram nose; and a sensor system comprising a first sensor on the ram body and a second sensor on the ram nose, wherein the first sensor is configured to detect a total force on the ram, and wherein the second sensor is configured to detect a force on a sidewall or on a bottom of a can formed from the metal blank.

EC 15. The redraw and ironing system of any of the preceding or subsequent example combinations, wherein the ram body comprises a front end and a back end, wherein the ram nose extends from the front end and comprises a ram nose end, and wherein the second sensor is on the ram nose between the front end of the ram body and the ram nose end.

EC 16. The redraw and ironing system of any of the preceding or subsequent example combinations, wherein the ram body comprises a front end and a back end, wherein the ram nose extends from the front end and comprises a ram nose end, and wherein the second sensor is on the ram nose end.

EC 17. The redraw and ironing system of any of the preceding or subsequent example combinations, further comprising a punch supported on the ram nose, wherein the punch comprises a punch nose and a punch sleeve, and wherein the ram nose is configured to cause the punch nose to engage a metal blank during an ironing process.

EC 18. The redraw and ironing system of any of the preceding or subsequent example combinations, wherein the punch sleeve is supported on the ram nose and selectively abuts that ram body.

EC 19. The redraw and ironing system of any of the preceding or subsequent example combinations, wherein the punch sleeve is supported on the ram nose such that the punch sleeve does not exert a force on the ram nose during processing.

EC 20. The redraw and ironing system of any of the preceding or subsequent example combinations, further comprising a spacer between the punch nose and the ram nose, wherein the spacer defines a gap between the punch nose and the punch sleeve such that a force on the punch nose is directed to the ram nose before the punch nose engages the punch sleeve.

EC 21. The redraw and ironing system of any of the preceding or subsequent example combinations, wherein the spacer comprises a third sensor of the sensor system configured to detect the force directed from the punch nose to the ram nose.

EC 22. The redraw and ironing system of any of the preceding or subsequent example combinations, further comprising a punch supported on the ram nose and a controller communicatively coupled to the first sensor and the second sensor, wherein the controller is configured to: receive total force data from the first sensor; receive ram nose force data from the second sensor; and determine a friction force between the punch and a can body based on the total force data and the ram nose force data.

EC 23. The redraw and ironing system of any of the preceding or subsequent example combinations, wherein the first sensor and the second sensor each comprise a load cell.

EC 24. The redraw and ironing system of any of the preceding or subsequent example combinations, wherein the ram comprises an outer surface and an inner surface defining an inner chamber, wherein the second sensor is on the outer surface of the ram on the ram nose, and wherein the first sensor is within the inner chamber in the ram body.

EC 25. The redraw and ironing system of any of the preceding or subsequent example combinations, further comprises a pressure system configured to apply a constant pressure within the inner chamber.

EC 26. A method of measuring and controlling redraw and ironing forces during an ironing process, the method comprising: engaging a punch of a redraw and ironing system with a metal blank, wherein the punch is supported on a ram nose of a ram of the redraw and ironing system; directing the metal blank through an ironing die by driving the ram to form a can body; and measuring a force on the ram nose with a first sensor of a sensor system as nose force data and measuring a total force on the ram with a second sensor as total force data while directing the metal blank through the ironing die.

EC 27. The method of any of the preceding or subsequent example combinations, further comprising determining a friction force between the can body and the punch based on the nose force data and the total force data.

EC 28. The method of any of the preceding or subsequent example combinations, further comprising adjusting at least one aspect of the redraw and ironing system based on any of the force measurements.

EC 29. The method of any of the preceding or subsequent example combinations, wherein the at least one aspect of the redraw and ironing system comprises at least one of a lubrication on the punch, metal properties of the metal blank, a surface characteristic of the punch, or a machine speed of the ram.

EC 30. The method of any of the preceding or subsequent example combinations, wherein the ram further comprises a ram body, wherein the ram body comprises an inner chamber, wherein the second sensor is within the inner chamber, and wherein the method further comprises maintaining a constant pressure within the inner chamber.

EC 31. The system or method of any of the preceding or subsequent example combinations, wherein the second sensor is configured to detect the force on both the sidewall and the bottom of the can formed from the metal blank.

EC 32. A redraw and ironing system comprising: a ram comprising a ram body and a ram nose; a punch supported on the ram nose and configured to engage a metal blank during a redraw and ironing process; and a sensor system comprising a first sensor and a second sensor, wherein the first sensor and the second sensor are configured to detect a process condition during the redraw and ironing process.

EC 33. The redraw and ironing system of any of the preceding or subsequent example combinations, wherein the process condition comprises at least one of a force on the ram, a temperature on the ram, a pressure within the ram, or an acceleration of the ram.

EC 34. The redraw and ironing system of any of the preceding or subsequent example combinations, wherein the ram nose extends from a front end of the ram body and comprises a ram nose end, wherein the first sensor is on the ram body and wherein the second sensor is on at least one of the ram nose, between the front end of the ram body and the ram nose end, or on the ram nose end.

EC 35. The redraw and ironing system of any of the preceding or subsequent example combinations, wherein the punch comprises a punch nose and a punch sleeve, wherein the punch nose is configured to engage the metal blank during processing, and wherein the punch sleeve is supported on the ram nose between the punch nose and the ram body.

The above-described aspects are merely possible examples of implementations, merely set forth for a clear understanding of the principles of the present disclosure. Many variations and modifications can be made to the above-described embodiment(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims that follow, they are used only in a generic and descriptive sense, and not for the purposes of limiting the described invention, nor the claims that follow.

That which is claimed:

1. A redraw and ironing system comprising:

a ram comprising a ram body and a ram nose elongated along an axis;

a punch supported on the ram nose and configured to engage a metal blank during a redraw and ironing process, wherein the punch comprises a punch nose and a punch sleeve, wherein the punch nose is configured to engage the metal blank during processing, and wherein the punch sleeve is supported on the ram nose between the punch nose and the ram body, and wherein the punch sleeve is movable relative to the punch nose;

a sensor system comprising a first sensor and a second sensor, wherein the first sensor is configured to detect a total force on the ram, and wherein the second sensor is configured to detect a force on a sidewall or on a bottom of a can formed from the metal blank; and a spacer comprising opposing ends along the axis, the spacer positioned between and abutting the punch nose and the ram nose, wherein a first opposing end of the opposing ends is between the punch nose and the ram nose and contacts the punch nose and a second opposing end of the opposing ends is between the punch nose and the ram nose and contacts the ram nose, wherein the spacer defines a gap between the punch nose and the punch sleeve such that a force on the punch nose is directed to the ram nose before the punch nose engages the punch sleeve.

2. The redraw and ironing system of claim 1, wherein the ram nose extends from a front end of the ram body and comprises a ram nose end, wherein the first sensor is on the ram body and wherein the second sensor is on at least one of the ram nose, between the front end of the ram body and the ram nose end, or on the ram nose end.

3. The redraw and ironing system of claim 1, wherein the ram body comprises a front end and a back end, wherein the ram nose extends from the front end, and wherein the punch sleeve abuts the ram body at the front end.

4. The redraw and ironing system of claim 1, further comprising a controller communicatively coupled to the first sensor and the second sensor, wherein the controller is configured to:

receive total force data from the first sensor;

receive ram nose force data from the second sensor; and determine a friction force between the punch and a can body based on the total force data and the ram nose force data.

5. The redraw and ironing system of claim 1, wherein the ram comprises an outer surface and an inner surface defining an inner chamber, wherein the second sensor is on the outer surface of the ram on the ram nose, and wherein the first sensor is within the inner chamber in the ram body.

6. A redraw and ironing system comprising:

a ram comprising a ram body and a ram nose;

a punch supported on the ram nose and configured to engage a metal blank during a redraw and ironing process, wherein the punch comprises a punch nose and a punch sleeve, wherein the punch nose is configured to engage the metal blank during processing, and wherein the punch sleeve is supported on the ram nose between the punch nose and the ram body;

a sensor system comprising a first sensor and a second sensor, wherein the first sensor is configured to detect a total force on the ram, and wherein the second sensor is configured to detect a force on a sidewall or on a bottom of a can formed from the metal blank; and a spacer positioned between and abutting the punch nose and the ram nose and without extending into the ram nose or the punch nose, wherein the spacer defines a gap between the punch nose and the punch sleeve such that a force on the punch nose is directed to the ram nose before the punch nose engages the punch sleeve, wherein the spacer comprises a third sensor of the sensor system configured to detect the force directed from the punch nose to the ram nose.

7. A redraw and ironing system comprising:

a ram comprising a ram body and a ram nose, the ram body comprising a front end and a back end, wherein the ram nose extends from the front end, and wherein the ram defines an inner chamber extending from the ram body to a ram nose end of the ram nose;

a punch comprising a punch sleeve supported on the ram nose and a punch nose, wherein the punch nose is configured to engage a metal blank during processing, and wherein the punch sleeve is supported on the ram nose between the punch nose and the ram body; and a sensor system comprising (i) a first sensor positioned within the inner chamber of the ram body and between the punch sleeve and the back end of the ram body and (ii) a second sensor positioned on the ram nose, wherein the first sensor is configured to detect a total force on the ram, wherein the second sensor is configured to detect a force on a sidewall or on a bottom of a can formed from a metal blank.

8. The redraw and ironing system of claim 7, further comprising a spacer between the punch nose and the ram nose, wherein the spacer defines a gap between the punch nose and the punch sleeve such that a force on the punch nose is directed to the ram nose before the punch nose engages the punch sleeve.

9. The redraw and ironing system of claim 8, wherein the spacer comprises a third sensor of the sensor system configured to detect the force directed from the punch nose to the ram nose.

10. The redraw and ironing system of claim 7, further comprising a controller communicatively coupled to the first sensor and the second sensor, wherein the controller is configured to:

receive total force data from the first sensor;

receive ram nose force data from the second sensor; and determine a friction force between the punch and a can body based on the total force data and the ram nose force data.

11. The redraw and ironing system of claim 7, wherein the second sensor is on an outer surface of the ram on the ram nose.

12. The redraw and ironing system of claim 11, further comprising a pressure system configured to apply a constant pressure within the inner chamber.

* * * * *